US011708235B2

(12) United States Patent
Tost et al.

(10) Patent No.: US 11,708,235 B2
(45) Date of Patent: Jul. 25, 2023

(54) HOSE REEL UNIT AND HOSE REEL ASSEMBLY COMPRISING A HOSE REEL UNIT

(71) Applicant: Andreas Stihl AG & Co. KG, Waiblingen (DE)

(72) Inventors: Christopher Tost, Auenwald (DE); Philipp Werner, Waiblingen (DE); Yannik Baumhackl, Kirchberg an der Murr (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 320 days.

(21) Appl. No.: 17/073,362

(22) Filed: Oct. 18, 2020

(65) Prior Publication Data

US 2021/0122605 A1 Apr. 29, 2021

(30) Foreign Application Priority Data

Oct. 24, 2019 (EP) ..... 19205182

(51) Int. Cl.

| | |
|---|---|
| ***B65H 75/44*** | (2006.01) |
| ***B08B 3/02*** | (2006.01) |
| ***B65H 75/40*** | (2006.01) |
| ***B65H 75/42*** | (2006.01) |

(52) U.S. Cl.

CPC ..... *B65H 75/4402* (2013.01); *B08B 3/026* (2013.01); *B65H 75/403* (2013.01); *B65H 75/42* (2013.01); *B65H 75/4457* (2013.01); *B65H 75/4478* (2013.01); *B65H 75/4494* (2013.01); *B08B 2203/0276* (2013.01); *B65H 2701/33* (2013.01)

(58) Field of Classification Search

None

See application file for complete search history.

(56) References Cited

U.S. PATENT DOCUMENTS

| | | | | | |
|---|---|---|---|---|---|
| 2,219,201 | A | * | 10/1940 | Smith | B65H 75/38 242/378 |
| 2,339,245 | A | * | 1/1944 | Bates | B65H 75/14 242/610.3 |
| 2,547,826 | A | * | 4/1951 | Kirschner | F16L 27/0808 285/279 |

(Continued)

FOREIGN PATENT DOCUMENTS

| | | | |
|---|---|---|---|
| EP | 0 904 855 | | 3/1999 |
| FR | 2 657 860 | * | 8/1991 |
| GB | 2 085 403 | | 4/1982 |

*Primary Examiner* — William A. Rivera

(74) *Attorney, Agent, or Firm* — Gudrun E. Huckett

(57) ABSTRACT

A hose reel unit for a high-pressure washer has a hose reel and a reel hose arranged in its receptacle. The hose reel is rotatable about an axis of rotation for winding and unwinding the reel hose. The first end of the reel hose is connectable to a supply line and the second end to a washer wand of the high-pressure washer. The hose reel has sidewalls delimiting the receptacle in a direction of the axis of rotation. The first end of the reel hose extends to the first sidewall and is coaxial to the axis of rotation. A guide device arranged between the sidewalls guides the reel hose such that the axis of rotation extends through the reel hose. The guide device is spaced apart form the first end of the reel hose at a support distance measured in a direction of the axis of rotation.

16 Claims, 8 Drawing Sheets

(56) References Cited

U.S. PATENT DOCUMENTS

| | | | | | |
|---|---|---|---|---|---|
| 2,642,312 | A * | 6/1953 | Shine | B65H 75/4478 | 137/355.2 |
| 2,696,406 | A * | 12/1954 | Myers | B65H 75/4471 | 137/382 |
| 2,718,655 | A * | 9/1955 | Cymara | B65H 75/38 | 15/246.2 |
| 3,011,201 | A * | 12/1961 | Cymara | A47L 5/38 | 15/310 |
| 3,476,139 | A * | 11/1969 | Guthrie | B65H 75/38 | 137/355.16 |
| 3,743,205 | A | 7/1973 | Misrach | | |
| 4,315,522 | A * | 2/1982 | Brown | B65H 75/38 | 137/355.27 |
| 4,506,698 | A * | 3/1985 | Garcia | B65H 75/38 | 137/355.27 |
| 4,512,361 | A * | 4/1985 | Tisbo | B65H 75/4465 | 137/355.27 |
| 4,586,676 | A * | 5/1986 | Johnston | B65H 75/4402 | 242/615.3 |
| 9,261,212 | B2 | 2/2016 | Eley et al. | | |
| 2009/0272412 | A1 * | 11/2009 | Steinhauser | B65H 75/42 | 134/198 |

* cited by examiner

HOSE REEL UNIT AND HOSE REEL ASSEMBLY COMPRISING A HOSE REEL UNIT

BACKGROUND OF THE INVENTION

The invention relates to a hose reel unit for a high-pressure washer, comprising a hose reel and a reel hose, wherein the hose reel comprises a receptacle for the reel hose. The reel hose comprises a first end for connection to a supply line of the high-pressure washer and a second end for connection to a washer wand. The hose reel is rotatable about an axis of rotation for winding the reel hose thereon and unwinding the reel hose therefrom. The receptacle is delimited in the direction of the axis of rotation by a first sidewall and by a second sidewall, wherein the reel hose is guided from the receptacle of the hose reel with its first end to the first sidewall. The invention further relates to hose reel assembly comprising such a hose reel unit.

U.S. Pat. No. 9,261,212 B2 discloses a hose reel unit comprising a hose reel and a reel hose. The hose reel unit is connected by the reel hose to a hose connector. The hose connector comprises two elements that can rotate relative to each other. The two elements are engaged across by an outer ring for mutual centering.

It is an object of the invention to further develop a hose reel unit of the aforementioned kind such that, while a simple manufacture of the hose reel unit is realized, a connection of the reel hose to a hose connector is possible with minimal wear of the hose connector.

A further object of the invention resides in providing a hose reel assembly that can be produced in a simple way and that exhibits also low wear.

SUMMARY OF THE INVENTION

In accordance with the invention, this is achieved in regard to the hose reel unit in that the first end of the reel hose is arranged coaxially to the axis of rotation, in that the hose reel unit comprises a guide device that guides the reel hose such that the axis of rotation extends through the reel hose, in that the guide device is arranged at a support distance, measured in the direction of the axis of rotation, from the first end of the reel hose, and in that the guide device is arranged between the first sidewall and the second sidewall.

In accordance with the invention, this is further achieved in regard to the hose reel assembly in that the first end of the reel hose is arranged coaxially to the axis of rotation, in that the hose reel unit comprises a guide device that guides the reel hose such that the axis of rotation extends through the reel hose, in that the guide device is arranged at a support distance, measured in the direction of the axis of rotation, from the first end of the reel hose, and in that the guide device is arranged between the first sidewall and the second sidewall, in that the hose reel assembly comprises two bearing supports of a high-pressure washer and a hose connector, in that the hose reel is rotatably supported about the axis of rotation in the bearing supports, in that one of the two bearing supports is supporting the first end of the reel hose coaxially to the axis of rotation, in that the reel hose is connected by the hose connector to the supply line, in that the hose connector comprises a connecting socket connected to the first end of the reel hose and a bearing socket connected to the supply line, in that the bearing socket is secured fixedly at one of the two bearing supports, and in that the connecting socket is rotatable relative to the bearing socket about the axis of rotation.

The invention thus provides that the first end of the reel hose is arranged coaxially to the axis of rotation. The hose reel unit comprises a guide device. The guide device guides the reel hose in such a way that the axis of rotation in the region of the guide device extends through the reel hose. The guide device is arranged at a support distance, measured in the direction of the axis of rotation, from the first end of the reel hose between the first sidewall and the second sidewall of the hose reel.

A hose reel unit with a coaxial arrangement of the first end of the reel hose relative to the axis of rotation can be produced easily. However, it has been found that in such an arrangement of the first end of the reel hose, when the reel hose is connected to a hose connector with a connecting socket and a bearing socket that are rotatable relative to each other, the hose connector exhibits great wear. In particular, sealing rings which are arranged between the two parts that are rotatably supported relative to each other wear quickly. The invention is based on the realization that this is associated with the fact that, when the hose reel is rotated, the portion of the reel hose which is located adjacent to the first end of the reel hose is moved back and forth transversely to the axis of rotation. This causes forces to act on the first end of the reel hose which are transmitted to the hose connector.

Due to the guide device according to the invention, the part of the reel hose which is located adjacent to the first end of the reel hose is supported between the first sidewall and the second sidewall. A movement back and forth of this part of the reel hose upon rotation of the hose reel therefore occurs only to a reduced degree or even not at all anymore. In this way, only minimal or no forces at all are transmitted from the first end of the reel hose to a hose connector to which the reel hose of the hose reel unit can be connected. In this way, a low-wear operation is possible when connecting the hose reel unit to a hose connector.

Advantageously, it is provided that the first sidewall is positioned away from the second sidewall at a sidewall distance, measured in the direction of the axis of rotation in an inner region of the hose reel surrounded by the receptacle, and provided that the support distance amounts to from 20% up to 80%, in particular from 40% up to 60%, of the sidewall distance.

Expediently, it is provided that the guide device is arranged at a wall distance, measured in the direction of the axis of rotation, from the first sidewall and that the wall distance amounts to from 20% up to 80%, in particular from 40% up to 60%, of the sidewall distance. In this way, the reel hose is supported in the area in which the largest back-and-forth movements transverse to the axis of rotation can occur during a rotation of the hose reel.

In particular, the guide device comprises an opening which is extending all the way through in the direction of the axis of rotation and through which the reel hose is guided. In this way, the reel hose can be supported in a simple way.

Expediently, the guide device comprises a slot which extends from the opening to an outer rim of the guide device. In this way, the reel hose can be inserted in a simple way by means of the slot from a circumferential side of the opening into the opening of the guide device.

Expediently, the slot tapers in the direction toward the axis of rotation. In this way, the reel hose is guided toward the opening and centered upon lateral insertion into the opening via the slot.

In an advantageous further embodiment of the invention, it is provided that a connecting location between the opening and the slot has an opening width and that the opening width is smaller than an outer diameter of the reel hose. In this way, the reel hose, when inserted via the slot into the opening, must first be forced through the connecting location and is subsequently secured in the opening against lateral sliding out due to the narrow connecting location.

Advantageously, the opening comprises at least partially a circular contour. Expediently, the center of the circular contour is positioned on the axis of rotation. In particular, the diameter of the circular contour of the opening corresponds to the outer diameter of the reel hose. In this way, the reel hose can be held in the opening without being compressed and can be secured against sliding out of the opening at the same time due to the restricted connecting location. It can also be provided that the outer diameter of the reel hose amounts to from 90% up to 110%, in particular from 95% up to 105%, preferably from 100% up to 103%, of the diameter of the circular contour.

In an advantageous further embodiment of the invention, it is provided that the guide device is embodied separate from the hose reel as an insertion component. In this way, the guide device can be retrofitted. In particular, the guide device is designed as a plate. In this way, the guide device can be produced in a simple way.

In an advantageous further embodiment of the invention, it is provided that the hose reel has two halves between which the guide device can be held by being clamped. Accordingly, the guide device can be attached in a simple way to the hose reel. Moreover, the guide device, in respect to the axis of rotation, can be held approximately at the center between the first sidewall and the second sidewall so that the reel hose is supported in this region in which the greatest back-and-forth movements of the reel hose occur during a rotation of the hose reel without the guide device.

The hose reel assembly according to the invention comprises a hose reel unit. Moreover, the hose reel assembly comprises two bearing supports of a high-pressure washer and a hose connector. The hose reel is supported in the bearing supports so as to be rotatable about the axis of rotation. One of the two bearing supports is supporting the first end of the reel hose coaxially to the axis of rotation. The reel hose is connected by means of the hose connector with the supply line of the high-pressure washer. The hose connector comprises a connecting socket that is connected to the first end of the reel hose and a bearing socket connected to the supply line. The bearing socket is fixedly secured at one of the two bearing supports. The connecting socket of the hose connector is rotatable relative to the bearing socket of the hose connector about the axis of rotation. In the hose reel assembly according to the invention, wear at the hose connector is reduced because only minimal or no forces at all are transmitted from the reel hose to the hose connector. In the region between the first end of the reel hose and the guide device, the reel hose performs only minimal or no movements at all in the direction perpendicular to the axis of rotation upon rotation of the hose reel.

In particular, the hose connector is sealed between the bearing socket and the connecting socket by means of seals. In particular, these seals are protected from wear in the hose reel assembly.

In an advantageous further embodiment of the invention, it is provided that the hose connector is arranged in a housing of the bearing support that is correlated with the bearing socket and that the hose connector is accessible through a service flap from the exterior of the housing. In this way, the hose connector can be inspected in a simple way.

Also, an exchange of the hose connector or of a part of the hose connector, as needed, is possible quickly and easily.

Expediently, the service flap is connected by a snap connection with the housing of the bearing support. In this way, the service flap can be opened and closed in a simple way. Moreover, the connection between the service flap and the housing can be produced in a simple way.

DESCRIPTION OF THE PREFERRED EMBODIMENTS

Figure 1:
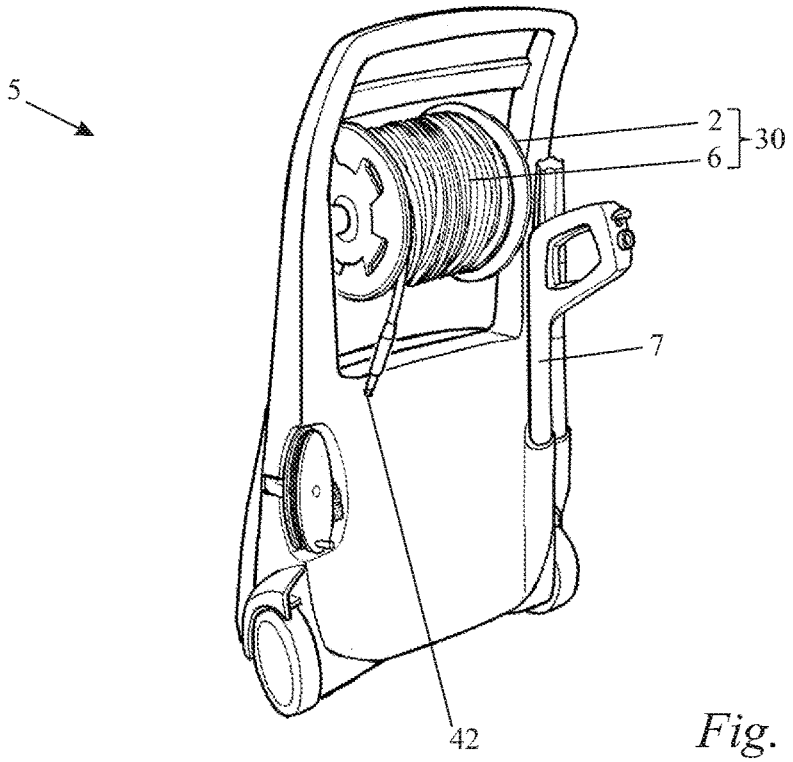
FIG. 1 is a perspective schematic illustration of a high-pressure washer.

FIG. 1 shows a schematic illustration of a high-pressure washer 5. The high-pressure washer 5 comprises a hose reel 2. The reel hose 6 is wound onto the hose reel 2. The reel hose 6 is also referred to as high-pressure washer hose. The reel hose 6 comprises a first end 41 and a second end 42. The second end 42 is provided for connecting to a washer wand 7. The hose reel 2 and the reel hose 6 are part of a hose reel unit 30.

Figure 2:
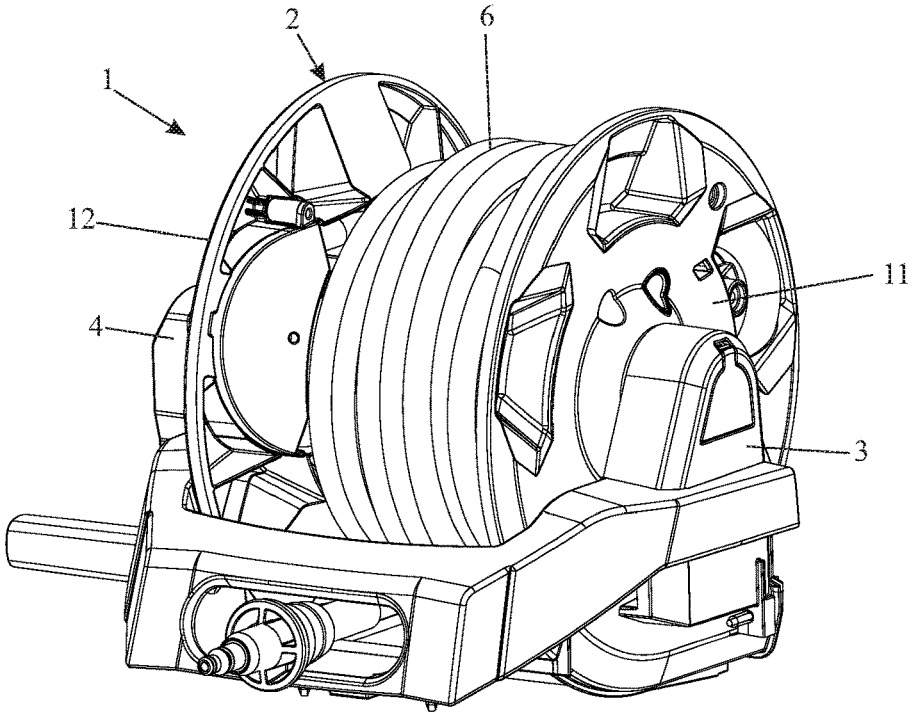
FIG. 2 is a perspective illustration of a hose reel assembly.

FIG. 2 shows a hose reel assembly 1. The hose reel assembly 1 comprises the hose reel unit 30, a first bearing support 3 of the high-pressure washer 5, a second bearing support 4 of the high-pressure washer 5, and a hose connector 9 which is illustrated in FIGS. 3 and 4.

Figure 3:
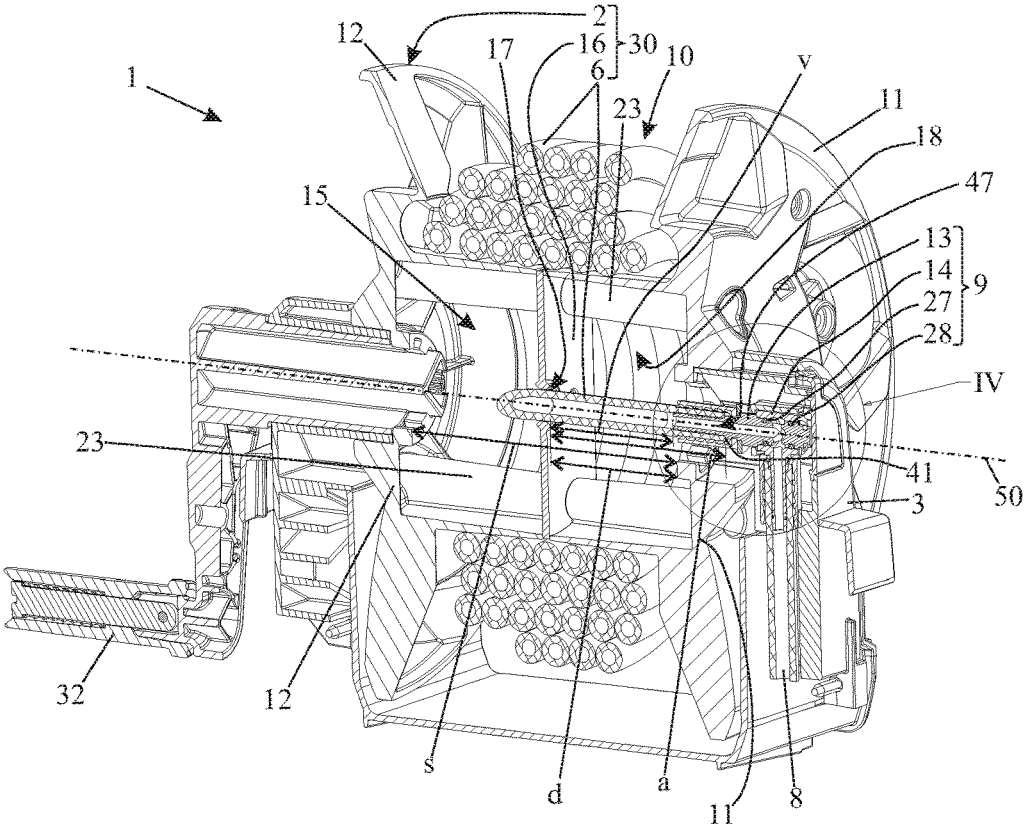
FIG. 3 is a three-dimensional illustration of a section through the hose reel assembly of FIG. 2.

As shown in FIG. 3, the reel hose 6 is connected by hose connector 9 with a supply line 8. Through the supply line 8, the reel hose 6 can be supplied with washer liquid.

The hose reel 2 is supported in the first bearing support 3 and in the second bearing support 4 so as to rotate about an axis of rotation 50. The first bearing support 3 supports the first end 41 of the reel hose 6 coaxially to the axis of rotation 50. The hose connector 9 comprises a connecting socket 13 and a bearing socket 14. The reel hose 6 is inserted into the connecting socket 13. The first end 41 of the reel hose 6 is connected fixedly to the connecting socket 13 of the hose connector 9. The bearing socket 14 is inserted into the supply line 8. The end of the supply line 8 which is facing the bearing socket 14 is connected fixedly to the bearing socket 14. The bearing socket 14 is secured fixedly and non-rotatingly at the first bearing support 3 with respect to the axis of rotation 50. The connecting socket 13 is rotatable relative to the bearing socket 14 about the axis of rotation 50. The connecting socket 13 is rotatably supported in the bearing socket 14.

Figure 4:
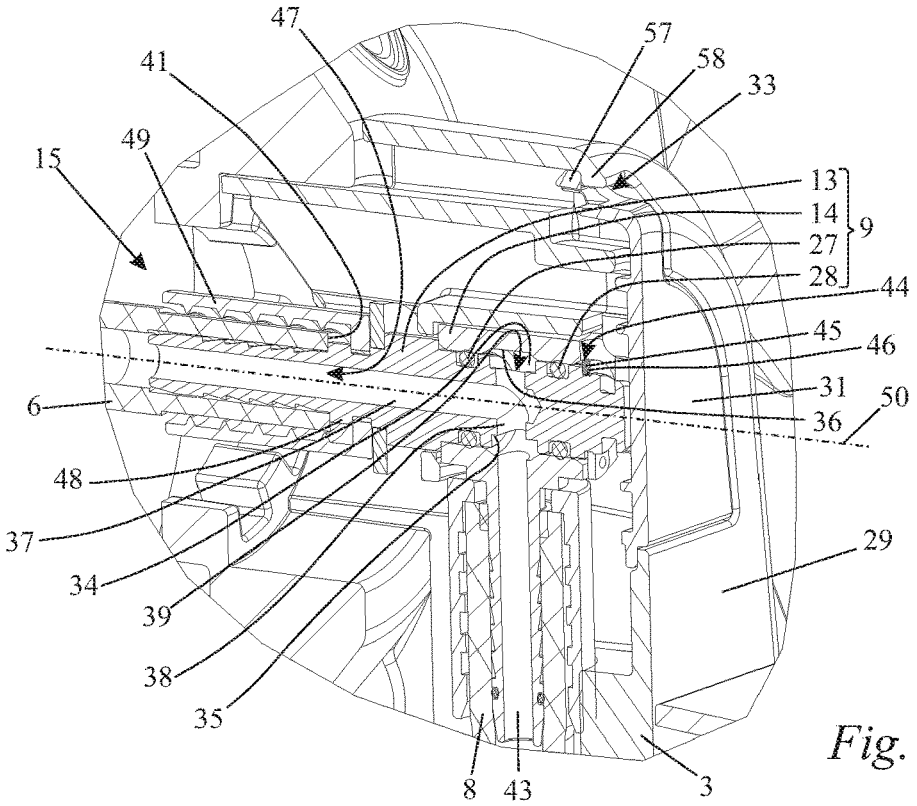
FIG. 4 is an illustration of a detail identified in FIG. 3 by IV.

As illustrated in FIG. 4, a cavity 34 is formed between the connecting socket 13 and the bearing socket 14. The cavity 34 is formed by a connecting groove 35 in the connecting socket 13 and a bearing groove 36 in the bearing socket 14. The connecting groove 35 and the bearing groove 36 extend circumferentially about the axis of rotation 50. The connecting socket 13 extends in the direction of the axis of rotation 50. The connecting groove 35 extends circumferentially about the outer side of the connecting socket 13.

The connecting socket 13 comprises a longitudinal channel 37. The longitudinal channel 37 extends in the direction of the axis of rotation 50. In the region of the connecting groove 35, the connecting socket 13 has a transverse channel 38. The transverse channel 38 extends transversely, in particular perpendicularly, to the axis of rotation 50. The transverse channel 38 extends transversely, in particular perpendicularly, to the longitudinal channel 37. In the embodiment, the transverse channel 38 completely penetrates the connecting socket 13 in the direction perpendicular to the axis of rotation 50. However, it can also be provided that the transverse channel 38 only partially penetrates the connecting socket 13. Due to the transverse channel 38, the longitudinal channel 37 comprises at least one opening 39 to the exterior side of the connecting socket 13. The opening 39 is arranged in the bottom of the connecting groove 35. Through the opening 39, the longitudinal channel 37 of the connecting socket 13 is connected to the cavity 34 between the connecting socket 13 and the bearing socket 14.

The bearing socket 14 comprises a channel 43 for guiding the supplied washer liquid. The channel 43 is connected to the cavity 34. The cavity 34 extends circumferentially about the axis of rotation 50. In this way, a connection for fluid communication between the channel 43 of the bearing socket 14 and the longitudinal channel 37 of the connecting socket 13 is ensured in any rotational position of the connecting socket 13. The channel 43 of the bearing socket 14 is connected in fluid communication to the supply line 8.

The bearing socket 14 comprises an eye 44. The eye 44 represents an opening in the bearing socket 14 which completely penetrates the bearing socket 14 in the direction of the axis of rotation 50. The connecting socket 13 is pushed in the direction of the axis of rotation 50 into the eye 44 of the bearing socket 14. The bearing groove 36 is introduced into the inner side of the eye 44. The connecting socket 13 comprises a projecting part arranged at the side of the bearing socket 14 which is facing away from the reel hose 6. In the projecting part, the connecting socket 13 comprises a securing groove 46. The securing groove 46 extends circumferentially about the axis of rotation 50. A securing ring 45 is arranged in the securing groove 46. The securing ring 45 projects past the opening of the eye 44 in the direction transverse to the axis of rotation 50. The securing ring 45 secures the connecting socket 13 against a movement in the direction of the axis of rotation 50. By means of the securing ring 45, the connecting socket 13 is secured against being pulled out of the bearing socket 14 in the direction of the reel hose 6.

The first bearing support 3 comprises a housing 29. The housing 29 comprises a service flap 31. The hose connector 9 is accessible through the service flap 31 of the housing 29 from the exterior of the housing 29. When the service flap 31 is open, it is possible, for example, to remove the securing ring 45 from the securing groove 46 of the connecting socket 13. Subsequently, the connecting socket 13 can be removed by a movement in the direction of the axis of rotation 50 away from the service flap 31 out of the bearing socket 14. In this way, an exchange of the connecting socket 13 or other components is possible.

The cavity 34 is sealed relative to the exterior side of the hose connector 9 by seals 27 and 28. A first seal 27 is arranged, in respect to the direction of the axis of rotation 50, at one side of the transverse channel 38 and a second seal 28 is arranged, in respect to the direction of the axis of rotation 50, on the other side of the transverse channel 38. The seals 27 and 28 in the embodiment are O-ring seals. The seals 27 and 28 are components of the hose connector 9.

As illustrated in FIG. 3, the hose reel 2 comprises a receptacle 10 for the reel hose 6. The receptacle 10 is delimited in the direction of the axis of rotation 50 by a first sidewall 11 of the hose reel 2 and by a second sidewall 12 of the hose reel 2. The receptacle 10 extends circumferentially about the axis of rotation 50. The first sidewall 11 and the second sidewall 12 are connected to each other by stays 23 in the embodiment. The first sidewall 11 and the second sidewall 12 are arranged in respect to the direction of the axis of rotation 50 at a distance from each other. The hose reel 2 is rotatable about axis of rotation 50 by means of a crank 32 for winding and unwinding the reel hose 6 from the hose reel 2.

An interior 15 of the hose reel 2 is delimited at least partially by the stays 23. In circumferential direction, in respect to the axis of rotation 50, a passage 18 is formed between the stays 23. The passage 18 connects the receptacle 10 with the interior 15. The interior 15 is accessible by the passage 18 from the exterior side of the hose reel 2. The interior 15 of the hose reel 2, in respect to a direction that is radial to the axis of rotation 50, is surrounded completely by the receptacle 10. The receptacle 10 extends in respect to the axis of rotation 50 completely about the interior 15. The reel hose 6 is guided between the stays 23 from the receptacle 10 into the interior 15. In the interior 15, the first end 41 of the reel hose 6 is connected to the connecting socket 13. The first end 41 of the reel hose 6 is arranged in the region of the first sidewall 11 of the hose reel 2. In the embodiment, the first end 41 of the reel hose 6 is arranged in the first sidewall 11 of the hose reel 2. The first end 41 of the reel hose 6 is arranged coaxially to the axis of rotation 50.

The hose reel unit 30 comprises a guide device 16. The guide device 16 guides the reel hose 6 in such a way that the axis of rotation 50 in the region of the guide device 16 extends through the reel hose 6. The guide device 16 is arranged in respect to the direction of the axis of rotation 50 between the first sidewall 11 and the second sidewall 12 of the hose reel 2. The guide device 16 is arranged at a support distance a, measured in the direction of the axis of rotation 50, from the first end 41 of the reel hose 6 between the first sidewall 11 and the second sidewall 12 of the hose reel 2.

The first end 41 of the reel hose 6 represents the outermost longitudinal end of the reel hose 6. A hose opening 47 of the reel hose 6 is provided at the first end 41. The connecting socket 13 of the hose connector 9 is inserted into the hose opening 47. As illustrated in FIG. 4, the connecting socket 13 has a projection 48. The projection 48 extends in a closed circumferential configuration about the axis of rotation 50. In the embodiment, the projection 48 is of a circular ring shape. The projection 48 serves as a stop for the reel hose 6.

The first end 41 of the reel hose 6 contacts the projection 48. The first end 41 of the reel hose 6 is formed by the end face of the reel hose 6. The reel hose 6 is secured by means of a sleeve 49 on the connecting socket 13. The sleeve 49 is contacting the outer circumference of the reel hose 6 and forces the reel hose 6 against the connecting socket 13. The sleeve 49 engages across the projection 48 and is thus secured against sliding in the direction of the axis of rotation 50 in a direction away from the connecting socket 13. The reel hose 6 is forced by the sleeve 49 against the connecting socket 13. When producing the connection between the reel hose 6 and the connecting socket 13, the sleeve 49 is pressed against the reel hose 6 and the reel hose 6 is plastically deformed. The reel hose 6 is connected fixedly, in particular for common rotation, to the connecting socket 13 of the hose connector 9.

The first sidewall 11 is positioned in respect to the second sidewall 12 at a sidewall distance s in the direction of the axis of rotation 50. The sidewall distances is measured in the interior 15 in the hose reel 2. The support distance a between the first end 41 of the reel hose 6 and the guide device 16 amounts to 20% to 80% of the sidewall distance s. In the embodiment, the support distance a amounts to 40% to 60% of the sidewall distance s.

The guide device 16 is arranged at a wall distance d, measured in the direction of the axis of rotation 50, away from the first sidewall 11. The wall distanced is measured in the interior 15 of the hose reel 2. The wall distance d amounts to 20% to 80% of the sidewall distance s. In the embodiment, the wall distance d between the guide device 16 and the first sidewall 11 amounts to 40% to 60% of the sidewall distance s between the first sidewall 11 and the second sidewall 12.

The guide device 16 comprises relative to the hose connector 9, in particular to the connecting socket 13, a connector distance v which is measured in the direction of the axis of rotation 50. The connector distance v is measured in the interior 15 of the hose reel 2. The connector distance v amounts to 20% to 80% of the sidewall distance s. In the embodiment, the connector distance v between the guide device 16 and the hose connector 9, in particular the connecting socket 13, amounts to 40% to 60% of the sidewall distance s between the first sidewall 11 and the second sidewall 12.

Figure 5:
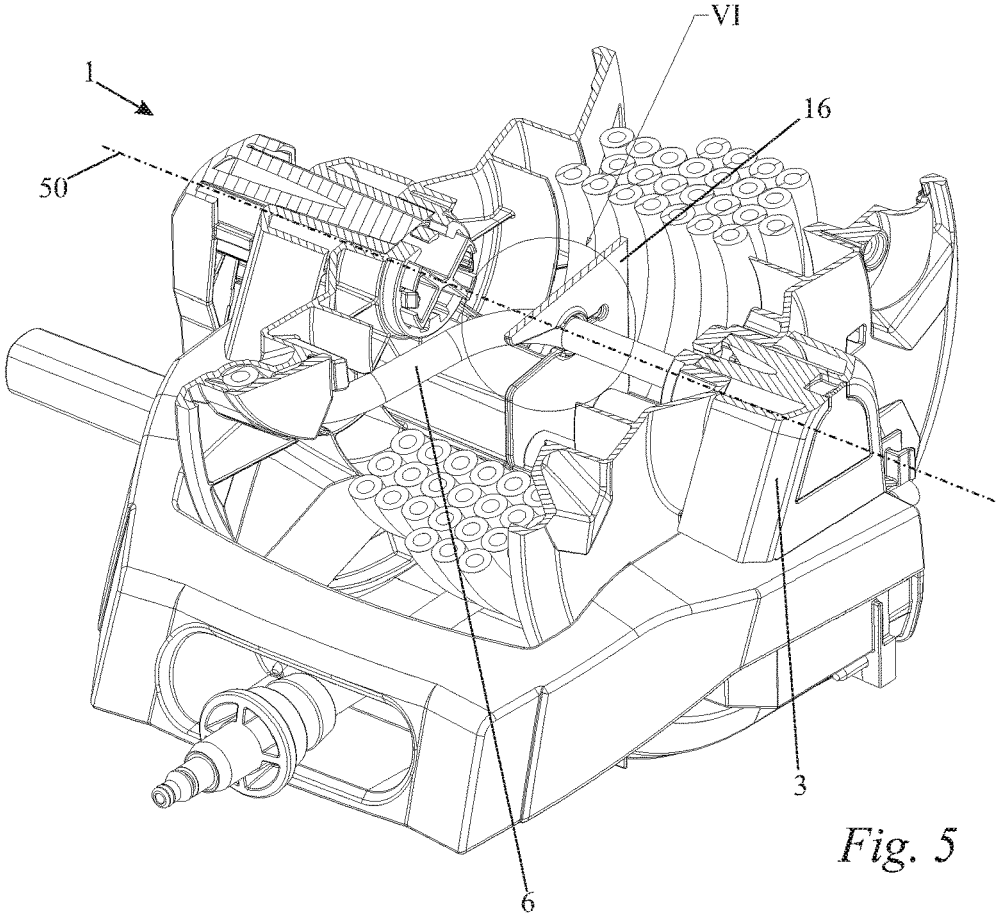
FIG. 5 is a perspective illustration of a hose reel assembly.
Figure 6:
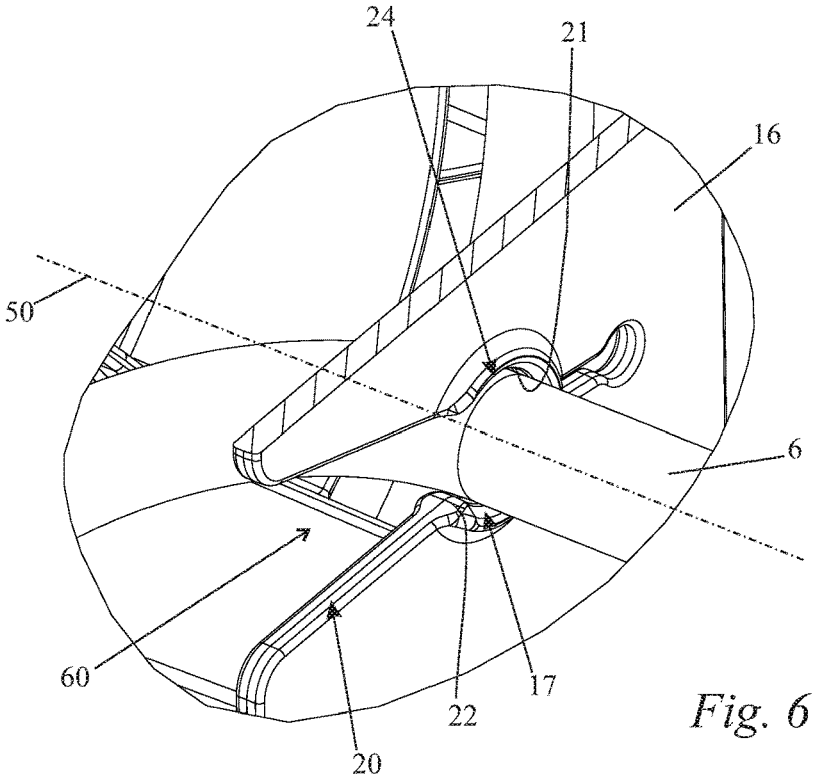
FIG. 6 is an illustration of a detail identified in FIG. 5 by VI.

As illustrated in FIGS. 5 and 6, the guide device 16 comprises an opening 17. The opening 17 extends in the direction of the axis of rotation 50. The opening 17 completely penetrates the guide device 16 in the direction of the axis of rotation 50. The opening 17 of the guide device 16 serves for guiding the reel hose 6. The reel hose 6 passes through the opening 17. A rim 21 of the opening 17 is contacting the reel hose 6. The rim 21 extends about the axis of rotation 50 about a circumferential angle range of at least 235° about the axis of rotation 50. In the embodiment, the circumferential angle range is comprised of two partial regions that are not connected with each other.

Figure 7:
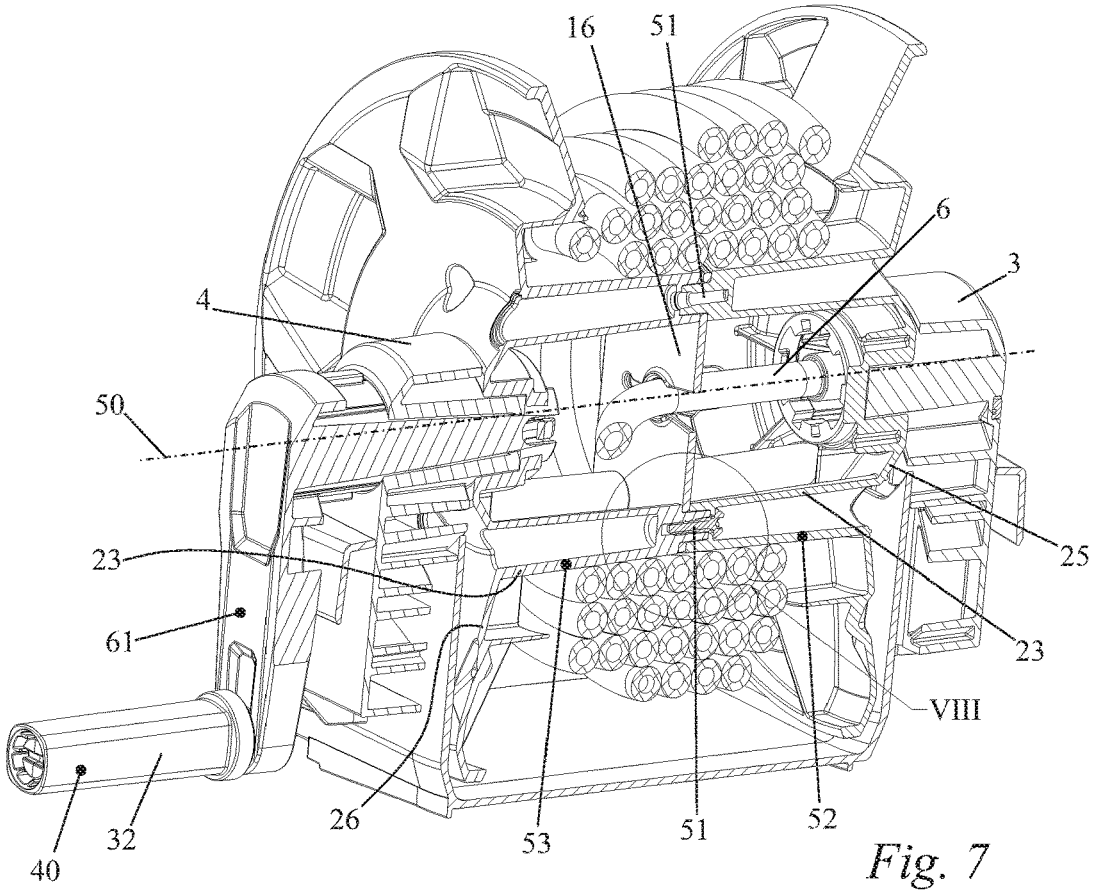
FIG. 7 is a three-dimensional illustration of a section through the hose reel assembly of FIG. 2.

As illustrated in particular in FIG. 7, the hose reel 2 comprises a first half 25 and a second half 26. The first half 25 and the second half 26 are positioned adjacent to each other in the direction of the axis of rotation 50. The first half 25 and the second half 26 are fastened to each other by means of fastening means 51. In the embodiment, the fastening means 51 are screws. The stays 23 are formed by the first half 25 as well as by the second half 26 of the hose reel 2. The stays 23 have a first part 52 and a second part 53. The first part 52 of the stay 23 is formed by the first half 25 of the hose reel 2. The second part of the stay 23 is formed by the second half 26 of the hose reel 2. The guide device 16 is held by being clamped between the first part 52 of the stay 23 and the second part 53 of the stay 23. The stay 23 penetrates a fastening opening 54 of the guide device 16. The guide device 16 is supported immediately at the hose reel 2.

The crank 32 illustrated in FIG. 7 serves for rotating the hose reel 2. The crank 32 is a foldable crank. The crank 32 comprises a handle 40 and a radial bar 61. The radial bar 61 is oriented in a direction that is radial to the axis of rotation 50.

When unfolded, the handle 40 extends in the direction of the axis of rotation 50. In the folded state, the handle 40 extends in a direction that is radial to the axis of rotation 50. In the folded state, the handle 40 is resting against the radial bar 61.

Figure 9:
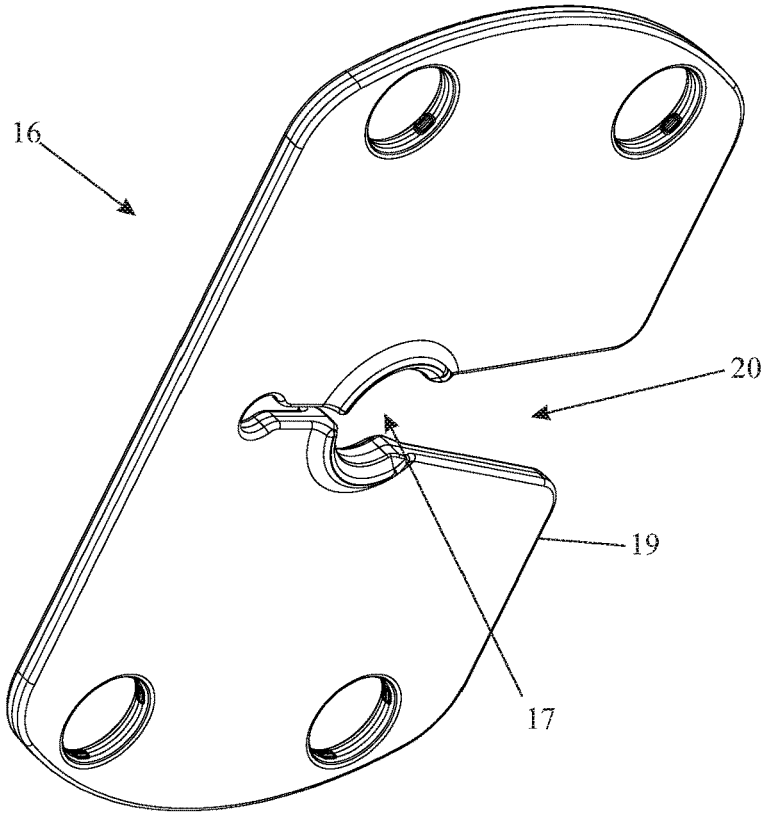
FIG. 9 is a perspective illustration of the guide device shown in FIGS. 3, 5, 6, and 7.

As illustrated in FIG. 9, the guide device 16 is embodied separate from the hose reel 2 as an insertion component. The guide device 16 is designed as a plate.

Figure 10:
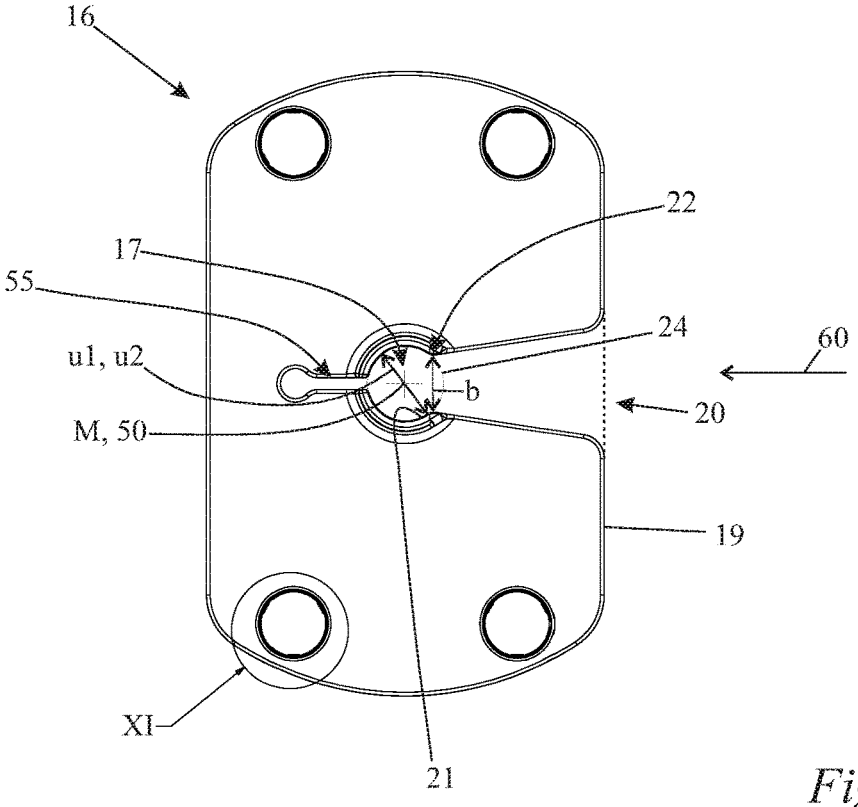
FIG. 10 is a side view of the guide device of FIG. 9.

The guide device 16 comprises a slot 20 which extends from the opening 17 of the guide device 16 to an outer rim 19 of the guide device 16. The slot 20 tapers in the direction toward the axis of rotation 50, as illustrated in FIG. 10. The outer rim 19 of the guide device 16 extends at least partially circumferentially about the axis of rotation 50. In the region of the slot 20, a continuation of the outer rim 19 is illustrated in FIG. 10 in a dashed line representation. At this location, the outer rim 19 is interrupted by the slot 20. Beginning at the outer rim 19 of the guide device 16, the slot 20 extends in the direction toward the axis of rotation 50 all the way to the opening 17. The slot 20 and the opening 17 are connected to each other by a connecting location 22. The connecting location 22 is at the same time the narrowest location of the opening 17 and the narrowest location of the slot 20. The connecting location 22 comprises an opening width b. The opening width b is measured perpendicular to an insertion direction 60 of the reel hose 6. The insertion direction 60 extends perpendicularly to the axis of rotation 50. The insertion direction 60 extends perpendicularly to the interrupted outer rim 19 in the region of the slot 20. The insertion direction 60 extends in the direction of the extension direction of the slot 20. The opening width b is smaller than an outer diameter u2 of the reel hose 6. The connecting location 22 forms an undercut for the reel hose 6 relative to the insertion direction 60.

The opening 17 of the guide device 16 comprises a contour 24 that is at least partially circular. In FIG. 10, the circular contour 24 is extended as a dashed line in the region of the connecting location 22. In the embodiment, the opening 17 comprises across at least 235° a circular contour 24 in respect to the axis of rotation 50. In the embodiment, the circular contour 24 is comprised of two parts. The two parts are of the same size. The two parts are separated from each other by a spring slot 55 at the side that is opposite the connecting location 22 in respect to the center point M of the circular contour 24. The spring slot 55 extends in the insertion direction 60. Due to the spring slot 55, even reel hoses with a diameter that is larger than the diameter u1 of the circular contour 24 can be received in the opening 17. In this context, the spring slot 55 enables widening of the opening 17 of the guide device 16. The center point M of the circular contour 24 is positioned on the axis of rotation 50. The circular contour 24 comprises a diameter u1. The diameter u1 of the circular contour 24 corresponds to the outer diameter u2 of the reel hose 6. The opening width b is smaller than the diameter u1 of the circular contour 24.

As illustrated in FIG. 6, the guide device 16 supports the reel hose 6. Due to the narrowed connecting location 22, the reel hose 6 in the region of the guide device 16 is secured against all movements in the direction that is perpendicular to the axis of rotation 50. Upon rotation of the hose reel 2, the entire hose 6 is rotated also. In this way, the first end 41 of the reel hose 6 is also rotated. The section of the reel hose 6 which is extending through the guide device 16 rotates together with the guide device 16. By guiding the reel hose 6 in the opening 17 of the guide device 16, the reel hose 6 however cannot perform a movement in the direction transverse to the axis of rotation 50 when rotating the hose reel 2. Transverse forces which are acting on the reel hose 6 in the direction transverse to the axis of rotation 50 in the region of the guide device 16 are absorbed by the guide device 16. In this way, fewer forces or no forces at all are transmitted from the reel hose 6, and in particular from the first end 41 of the reel hose 6, to the hose connector 9. In particular, a transverse force transmission from the first end 41 of the reel hose 6 to the connecting socket 13 of the hose connector 9 hardly exists or does not exit at all. In this way, hardly any transverse forces are transmitted to the seals 27 and 28 which are illustrated in FIG. 4. Upon rotation of the connecting socket 13 in the bearing socket 14, the longitudinal channel 37 of the connecting socket 13 and the channel 43 of the bearing socket 14 are almost always aligned perpendicularly to each other.

Figure 8:
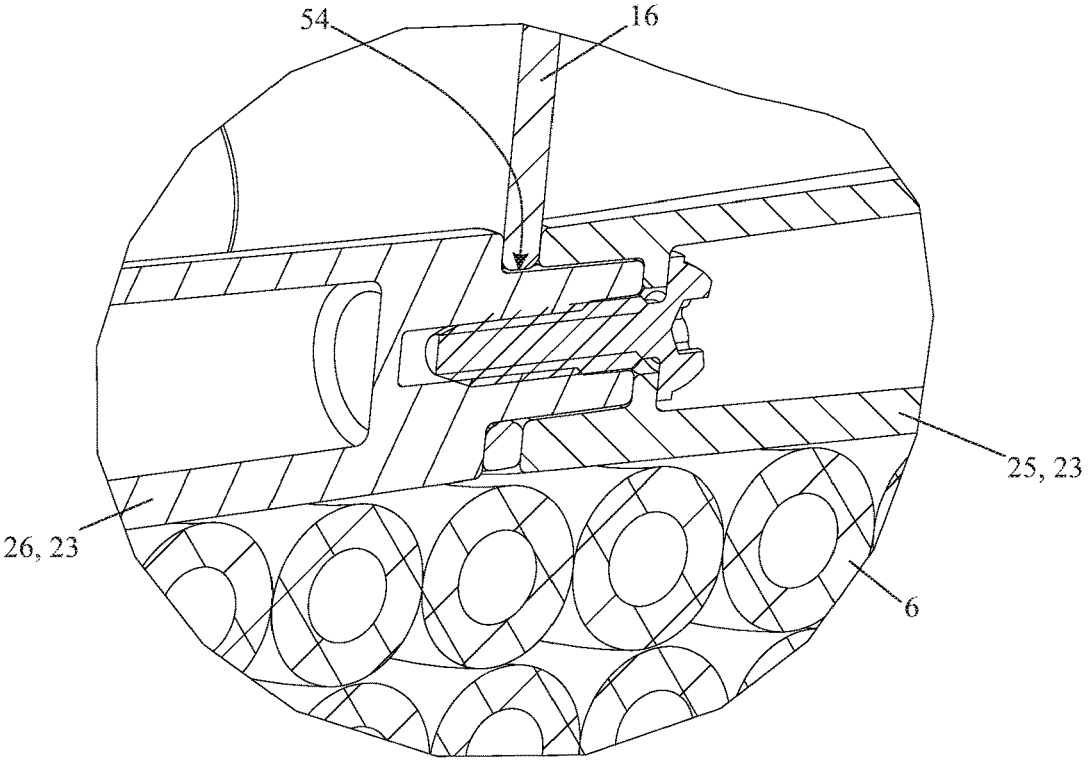
FIG. 8 is an illustration of a detail identified in FIG. 7 by VIII.
Figure 11:
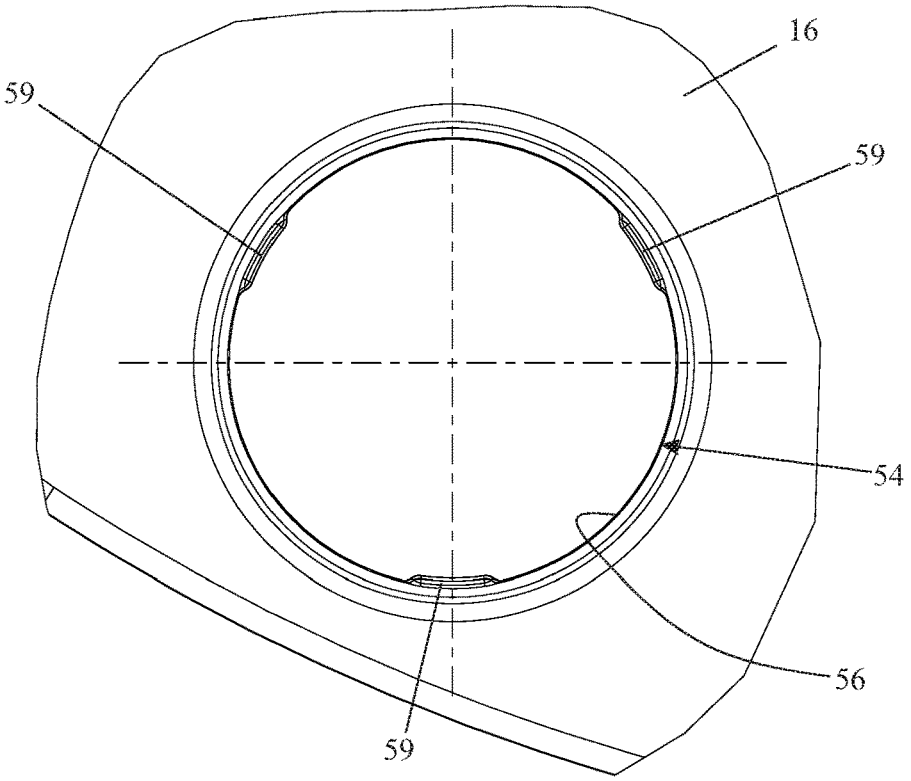
FIG. 11 is an illustration of a detail identified in FIG. 10 by Xl.
Figure 12:
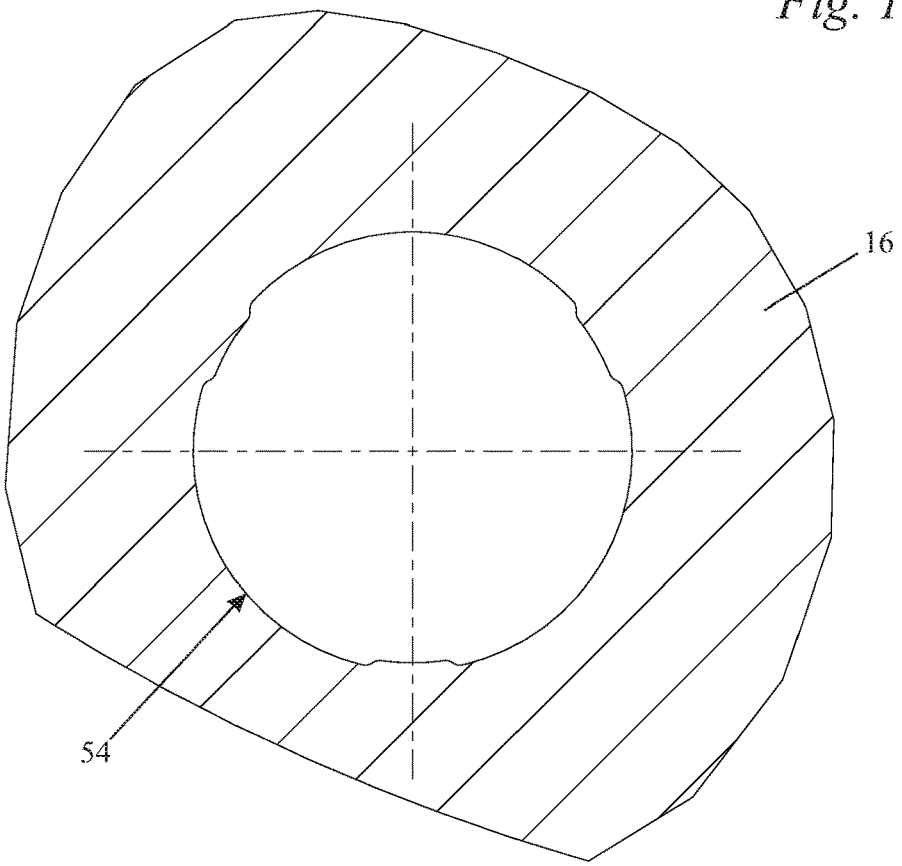
FIG. 12 is an illustration of a section perpendicular to the axis of rotation through the detail illustrated in FIG. 11.

As illustrated in FIGS. 11 and 12, the fastening opening 54 of the guide device 16 comprises a rim 56. The rim 56 is circular. Three projections 59 project past the rim 56 in the direction toward the center of the rim 56. The three projections 59 serve as three-point supports for the stay 23, as can be seen in FIG. 8. The fastening opening 54 is resting with the projections 59 against the stay 23. In this way, a precise orientation of the guide device 16 relative to the hose reel 2 is possible.

Figure 13:
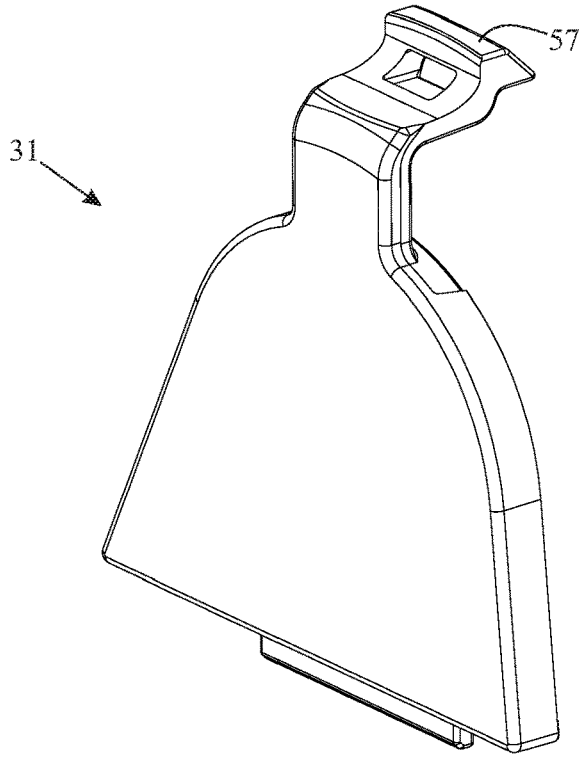
FIG. 13 is a perspective illustration of the service flap shown in FIGS. 2, 4, and 5.
Figure 14:
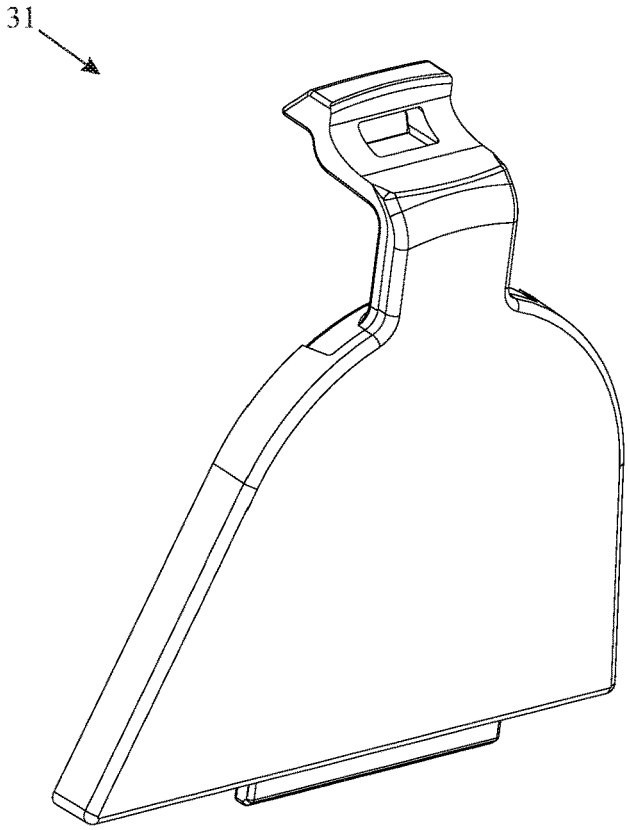
FIG. 14 is another perspective illustration of the service flap of FIG. 13.
Figure 15:
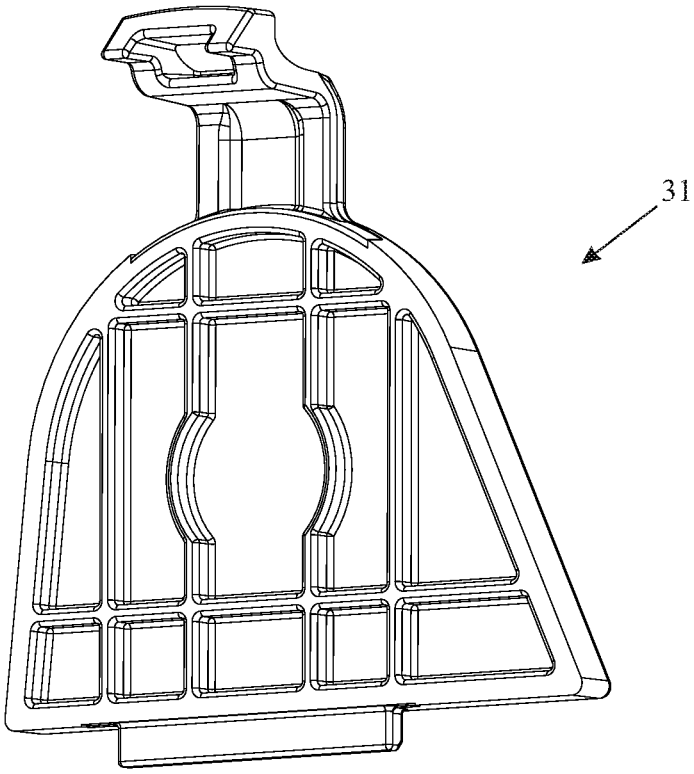
FIG. 15 is a further perspective illustration of the service flap of FIG. 13.

FIGS. 13 to 15 show perspective illustrations of the service flap 31. The service flap 31 comprises at its upper end a snap hook 57. As can be seen in FIG. 4, the snap hook 57 of the service flap 31 forms a snap connection 33 together with the base body 58 of the housing 29 of the first bearing support 3.

The specification incorporates by reference the entire disclosure of European priority document 19 205 182.9 having a filing date of Oct. 24, 2019.

While specific embodiments of the invention have been shown and described in detail to illustrate the inventive principles, it will be understood that the invention may be embodied otherwise without departing from such principles.

What is claimed is:

1. A hose reel unit for a high-pressure washer, the hose reel unit comprising:

a hose reel comprising a receptacle;

a reel hose disposed in the receptacle and comprising a first end configured to connect to a supply line of the high-pressure washer and further comprising a second end configured to connect to a washer wand of the high-pressure washer;

a guide device configured to guide the reel hose;

wherein the hose reel is configured to rotate about an axis of rotation for winding and unwinding the reel hose;

wherein the hose reel comprises a first sidewall and a second sidewall delimiting the receptacle in a direction of the axis of rotation;

wherein the first end of the reel hose extends from the receptacle of the hose reel to the first sidewall;

wherein the first end of the reel hose is arranged coaxially to the axis of rotation;

wherein the guide device is arranged between the first sidewall and the second sidewall and guides the reel hose such that the axis of rotation extends through the reel hose;

wherein the guide device is spaced apart from the first end of the reel hose at a support distance, the support distance measured in the direction of the axis of rotation;

wherein the guide device comprises an opening extending through the guide device in the direction of the axis of rotation, wherein the reel hose passes through the opening.

2. The hose reel unit according to claim 1, wherein the first sidewall is spaced apart from the second sidewall at a sidewall distance, measured in the direction of the axis of rotation in an interior of the hose reel that is surrounded by the receptacle, wherein the support distance amounts to 20% to 80% of the sidewall distance.

3. The hose reel unit according to claim 2, wherein the guide device is spaced apart from the first sidewall at a wall distance, measured in the direction of the axis of rotation, wherein the wall distance amounts to 20% to 80% of the sidewall distance.

4. The hose reel unit according to claim 1, wherein the opening comprises at least partially a circular contour.

5. The hose reel unit according to claim 4, wherein a center point of the circular contour is positioned on the axis of rotation.

6. The hose reel unit according to claim 4, wherein a diameter of the circular contour corresponds to an outer diameter of the reel hose.

7. The hose reel unit according to claim 1, wherein the guide device is embodied as an insertion component that is separate from the hose reel.

8. The hose reel unit according to claim 7, wherein the insertion component is a plate.

9. The hose reel unit according to claim 1, wherein the hose reel comprises two halves and the guide device is clamped between the two halves.

10. A hose reel unit for a high-pressure washer, the hose reel unit comprising:

a hose reel comprising a receptacle;

a reel hose disposed in the receptacle and comprising a first end configured to connect to a supply line of the high-pressure washer and further comprising a second end configured to connect to a washer wand of the high-pressure washer;

a guide device configured to guide the reel hose;

wherein the hose reel is configured to rotate about an axis of rotation for winding and unwinding the reel hose;

wherein the hose reel comprises a first sidewall and a second sidewall delimiting the receptacle in a direction of the axis of rotation;

wherein the first end of the reel hose extends from the receptacle of the hose reel to the first sidewall;

wherein the first end of the reel hose is arranged coaxially to the axis of rotation;

wherein the guide device is arranged between the first sidewall and the second sidewall and guides the reel hose such that the axis of rotation extends through the reel hose;

wherein the guide device is spaced apart from the first end of the reel hose at a support distance, the support distance measured in the direction of the axis of rotation;

wherein the guide device comprises an opening extending through the guide device in the direction of the axis of rotation, wherein the reel hose passes through the opening;

wherein the guide device comprises a slot extending from the opening to an outer rim of the guide device.

11. The hose reel unit according to claim 10, wherein the slot tapers from the outer rim in a direction toward the axis of rotation.

12. The hose reel unit according to claim 10, wherein a connecting location is provided between the opening and the slot, wherein the connecting location has an opening width, wherein the opening width is smaller than an outer diameter of the reel hose.

13. A hose reel assembly for a high-pressure washer, the hose reel assembly comprising:

a hose reel unit comprising:

a hose reel comprising a receptacle;

a reel hose disposed in the receptacle and comprising a first end and a second end;

a hose connector connecting the first end of the reel hose to a supply line of the high-pressure washer, wherein the second end of the reel hose is configured to connect to a washer wand of the high-pressure washer;

a guide device configured to guide the reel hose;

a first bearing support and a second bearing support of the high-pressure washer, wherein the hose reel is supported in the first bearing support and in the second bearing support so as to be rotatable about an axis of rotation for winding and unwinding the reel hose;

wherein the hose reel comprises a first sidewall and a second sidewall delimiting the receptacle in a direction of the axis of rotation;

wherein the first end of the reel hose extends from the receptacle of the hose reel to the first sidewall;

wherein the first end of the reel hose is arranged coaxially to the axis of rotation and is supported coaxially to the axis of rotation by a first one of the two bearings supports;

wherein the guide device is arranged between the first sidewall and the second sidewall and guides the reel hose such that the axis of rotation extends through the reel hose;

wherein the guide device is spaced apart form the first end of the reel hose at a support distance, the support distance measured in the direction of the axis of rotation;

wherein the guide device comprises an opening extending through the guide device in the direction of the axis of rotation, wherein the reel hose passes through the opening;

wherein the hose connector comprises a connecting socket connected to the first end of the reel hose and a bearing socket connected to the supply line of the high-pressure washer, wherein the bearing socket is secured fixedly at the first bearing support, and wherein the connecting socket is rotatable relative to the bearing socket about the axis of rotation.

14. The hose reel assembly according to claim 13, wherein the hose connector is sealed by seals arranged between the bearing socket and the connecting socket.

15. The hose reel assembly according to claim 13, wherein the hose connector is arranged in a housing of the first bearing support, wherein the housing comprises a service flap, and wherein the hose connector is accessible via the service flap from an exterior of the housing.

16. The hose reel assembly according to claim 15, wherein the service flap is secured by a snap connection at the housing.

* * * * *